US006688633B2

(12) United States Patent
van't Schip

(10) Patent No.: US 6,688,633 B2
(45) Date of Patent: Feb. 10, 2004

(54) ROLLING AID FOR USE BY ELDERLY AND DISABLED PEOPLE

(76) Inventor: Joannes Stefanus van't Schip, 235, Langeweide, 1722 WJ Zuid-Scharwoude (NL)

( * ) Notice: Subject to any disclaimer, the term of this patent is extended or adjusted under 35 U.S.C. 154(b) by 0 days.

(21) Appl. No.: 10/177,772

(22) Filed: Jun. 24, 2002

(65) Prior Publication Data

US 2002/0195785 A1 Dec. 26, 2002

Related U.S. Application Data

(63) Continuation of application No. PCT/NL01/00006, filed on Jan. 5, 2001.

(30) Foreign Application Priority Data

Jan. 6, 2000 (NL) ..... 1014025
May 12, 2000 (NL) ..... 1015178

(51) Int. Cl.[7] ..... A61H 3/04

(52) U.S. Cl. ..... 280/642; 280/647; 280/87.05; 280/87.041; 135/67

(58) Field of Search ..... 280/47.34, 87.05, 280/42, 87.021, 87.041, 639, 641, 642, 646, 647, 649, 644; 135/65, 67, 72, 74

(56) References Cited

U.S. PATENT DOCUMENTS 2,685,325 A * 8/1954 Webster ..... 297/30
3,142,351 A * 7/1964 Green ..... 180/8.2
4,335,893 A * 6/1982 Carmichael et al. ..... 280/42
5,020,560 A * 6/1991 Turbeville ..... 135/67
5,240,276 A * 8/1993 Coombs ..... 280/647
5,244,222 A * 9/1993 Benoit ..... 280/250.1
5,348,336 A 9/1994 Fernie et al. ..... 280/641
5,409,028 A * 4/1995 Lee ..... 135/66
5,496,050 A * 3/1996 Geiger et al. ..... 280/250.1
5,603,517 A * 2/1997 Lorman ..... 280/5.2
5,687,984 A 11/1997 Samuel ..... 280/641
5,716,063 A * 2/1998 Doyle et al. ..... 280/87.05
5,772,234 A * 6/1998 Luo ..... 280/642
5,806,854 A * 9/1998 Coleman et al. ..... 273/292
5,816,593 A * 10/1998 Che ..... 280/87.041
5,857,688 A * 1/1999 Swearingen ..... 280/250.1
6,135,475 A * 10/2000 Brown et al. ..... 280/250.1
6,311,708 B1 * 11/2001 Howle ..... 135/67

FOREIGN PATENT DOCUMENTS

DE 0E 43 28 875 2/1995

* cited by examiner

*Primary Examiner*—Brian L. Johnson
*Assistant Examiner*—Christopher Bottorff
(74) *Attorney, Agent, or Firm*—Blank Rome LLP

(57) ABSTRACT

An aid for use when transporting elderly people and disabled people, comprising a frame provided with handle bars, the frame comprising a front and a rear frame section, each essentially consisting of a pair of frame bars or frame tubes with transverse connections, the frame bars or frame tubes having their lower ends designed for movement across the ground and the frame sections being foldably connected about a transverse axis that is located under handle bar level. The frame sections are also foldable in the transverse direction, due to the transverse connections between the frame tubes of the frame sections being formed by connecting bars which are adapted to be folded in or substantially in the plane of the respective frame section. The aid is adapted to be used both as a walking aid (rollator) and as a passive wheel chair.

10 Claims, 5 Drawing Sheets

ROLLING AID FOR USE BY ELDERLY AND DISABLED PEOPLE

CROSS-REFERENCE TO RELATED APPLICATION

This a continuation application of PCT/NL01/00006 filed Jan. 5, 2001, which PCT application claims priority of Dutch patent application number 1014025 filed Jan. 6, 2000 and of Dutch patent application number 1015178 filed May 12, 2000, both herein incorporated by reference.

FIELD OF THE INVENTION

The invention relates to a rolling aid for use by elderly and disabled people. Such aids are well-known e.g. as "rollator" or "walker" which are used by elderly people and disabled people to render self-reliant walking easier and safer.

BACKGROUND OF THE INVENTION

An aid of the latter type, being in fact a walking aid, is known from DE 4328875. The advantage of this well-known aid is to be seen in that its frame is foldable in both the rolling (walking) direction and the transverse direction, so that in the (completely) folded state, it occupies so little space, that it may be readily carried along when going by bus or tram, or taken along in the trunk of an automobile. The well-known aid, however, has certain disadvantages which may affect the ease of use as will be explained hereinafter.

With the well-known device the second foldable transverse connection is carried out in the form of two articulated V-bars, which have the respective apex directed upwardly and downwardly respectively and cross one another to form a double linkage, wherein one leg of each articulated V-bar extends through and is pivotally connected to a bifurcated leg of the other V-bar. The outer ends of the V-bar that has its apex directed upwardly, engage the frame tubes of the first pair of frame tubes, whereas the outer ends of the V-bar that has its apex directed downwardly, engage the ends of the sections of the frame tubes of the second pair of frame tubes that deviate substantially horizontally towards said first pair of frame tubes and extend parallel to one another. In order that folding in the transverse direction will cause the frame tubes of both pairs of frame tubes to move towards one another in the rolling (walking) direction, it is essential that the V-bars are located in a plane that makes an angle with the plane in which the frame tubes of the first pair of frame tubes are located, and that this angle will decrease when folding. The latter condition, however, implies that the outer ends of the V-bars must be allowed to pivot relative to the frame tubes of the first pair of frame tubes and relative to the horizontally deviating sections of the frame tubes of the second pair of frame tubes respectively about two mutually perpendicular axes, which involves a rather complex structure and may be detrimental to a smooth folding and unfolding procedure respectively.

SUMMARY OF THE INVENTION

The invention aims at providing an improved rolling aid, which does not have the disadvantages mentioned hereinabove. According to the invention this aim is achieved thanks the features mentioned in claim 1.

Thanks the features of the invention the hinge bars of the second foldable transverse connection may be simply positioned within the plane of the frame tubes of the first pair of frame tubes and may thus pivot about single axes at right angles to this plane, while the required concurrence of the procedure of folding in the transverse direction and the procedure of folding in the rolling (walking) direction is effected in a smooth manner by the sections of the frame tubes of the second pair of frame tubes, which extend—in the rolling (walking) position—obliquely inwardly and are rotatably mounted to the respective hinge joint platform halves. Moreover, the obliquely inwardly directed frame tube sections substantially contribute to the stability of the aid.

A simple and practical embodiment of the aid of the present invention also has the features of claim 2. In this case the second foldable transverse connection comprises two crossing links only, which in the unfolded position need to function as a "shore" only.

An alternative embodiment having the possibility of locking the aid in the use-position, has the features of claims 3–5.

A particular embodiment of the aid of the present invention has the features mentioned in claim 6 and 7, wherein the feature of claim 6 provides for a simple way of preventing the deviating frame tube sections, which are rotatably mounted to the hinge joint platform, from turning about their axes relative to one another, and the feature of claim 7 provides for handle bars, to which merely a vertically directed lifting force needs to be applied to have the frame of the aid fold together simultaneously in both directions (transverse direction and rolling (walking) direction).

It will be understood that when the aid according to the present invention is used as a rollator (rolling walking aid) the pair of frame tubes which hereinabove is defined as "the first pair of frame tubes" will constitute the forward pair of frame tubes and that "the second pair of frame tubes" may in that case be considered as the rear pair of frame tubes.

Through the features defined in claims 6 and 7 the aid according to the present invention is also suitable for use as a wheel chair. In that case the handle bars, which function as push handle bars in case of use as a rollator, may in case of use as a wheel chair, fulfil the function of armrests, whereas the handle bars at the upper end of the upwardly directed tube sections of the frame tubes of the second pair of frame tubes (claim 7) may serve—when using the aid as a wheel chair—as push handle bars. Moreover, a "real" backrest could be provided, removably if desired, in two parts. In that case the rolling direction is opposite to that in case of using the aid as a rollator.

BRIEF DESCRIPTION OF THE DRAWINGS

Further features and advantages of the rolling aid according to the present invention are explained hereinafter by way of two examples with reference to the accompanying drawing.

DESCRIPTION OF THE PREFERRED EMBODIMENTS

Figure 1:
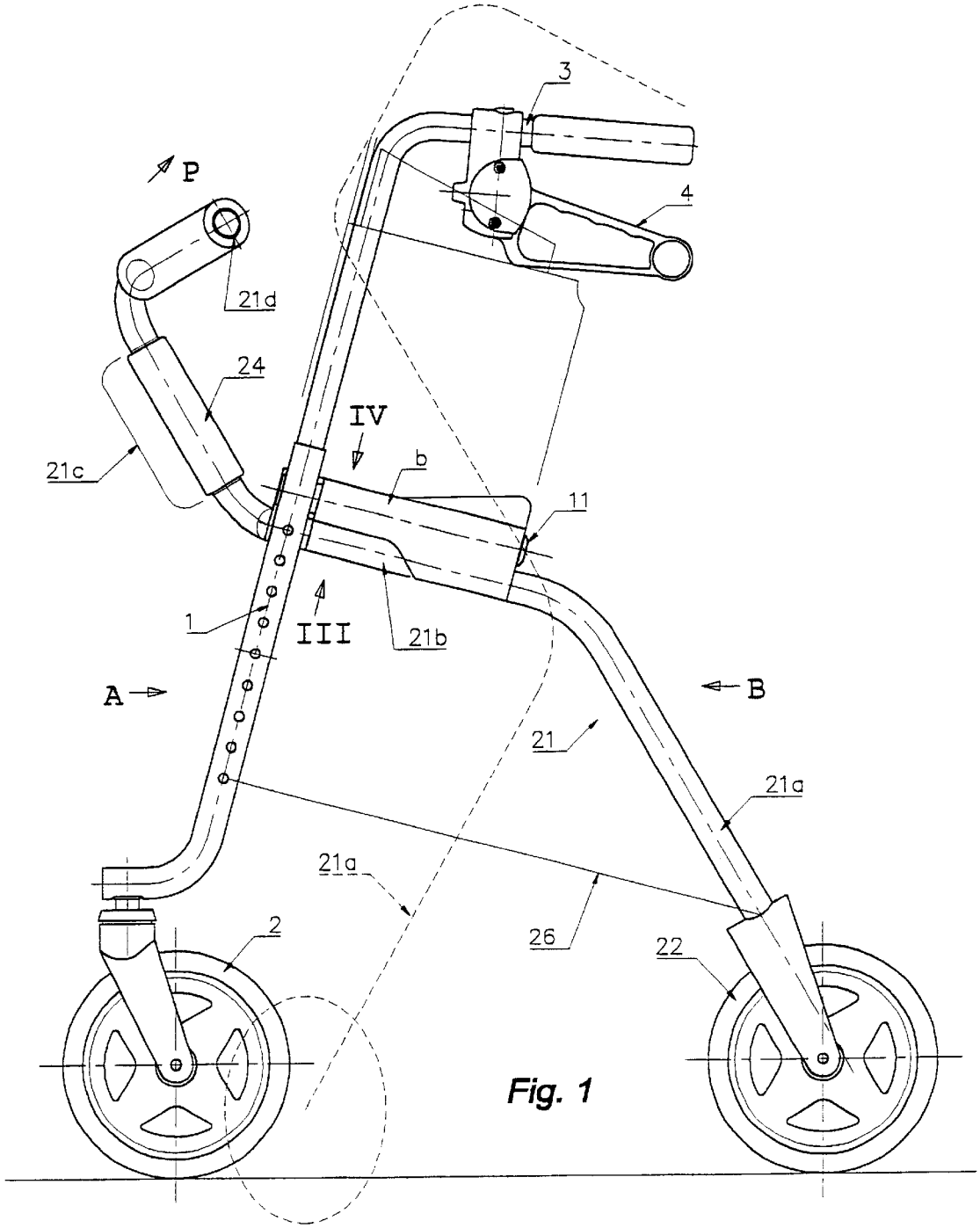
FIG. 1 is an elevational view of the aid according to the invention, designed as a rolling walking aid or "rollator"

With reference to FIG. 1, the walking aid shown therein in the use position essentially consists of a front frame section A and a rear frame section B. The front frame section A (see also FIG. 2) comprises two transversely spaced and parallel frame tubes 1, each with a lower, forwardly bent end portion provided with a front wheel 2, while each of the frame tubes have an upper, extended end portion which is bent to a handle bar 3. 4 is a lever mechanism mounted adjacent the handle 3 and serving to control a device (not shown) for blocking the wheels 2.

In the use-position shown in FIG. 1 the front frame section A is taking a slightly rearwardly inclined position (e.g. at an angle of 15°). Between the frame tubes 1 of the front frame section A there are provided a lower transverse connection a and an upper transverse connection b. The lower transverse connection is constituted by a hinge joint bar, the two bar halves $a_1$ are pivotally connected to opposite pivot plates 5 provided on the respective tubes and are pivotally connected to one another in the center by means of a connecting piece 6. The lower end of an upwardly extending tie rod 7 positioned in the plane of the frame section A is also connected to the connecting piece 6. From each of the opposite pivot plates 5 a support link 8 extends obliquely upwardly towards the center between the two frame tubes 1, where the two support links 8 pivotally connect to a guide piece 9, through which the tie rod 7 extends upwardly.

Figure 3:
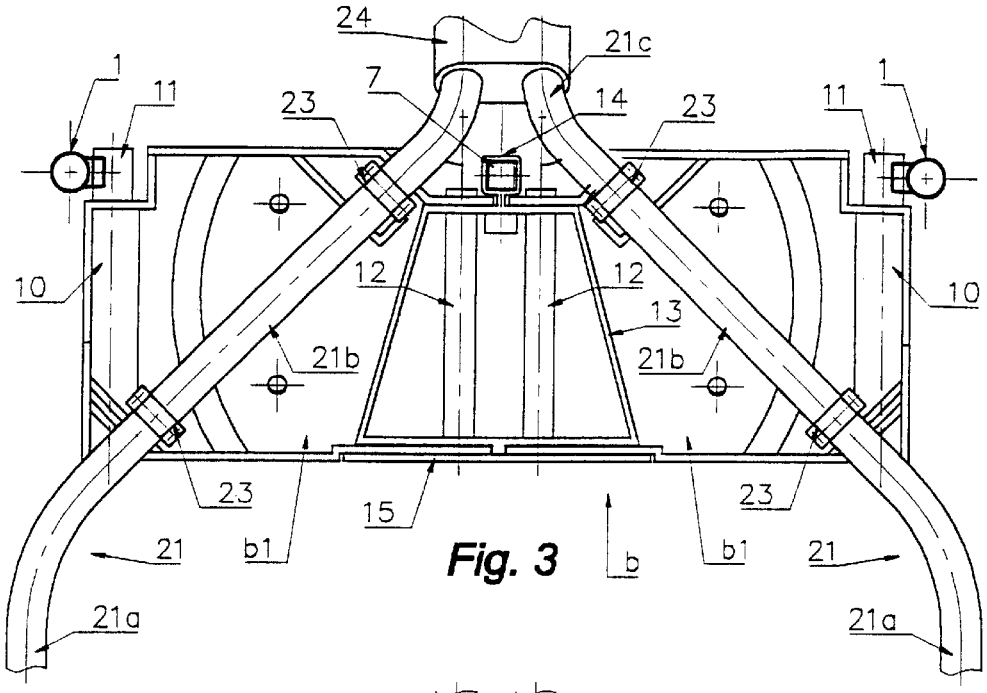
FIG. 3 is a plan view according to the arrow III in FIG. 1.
Figure 4:
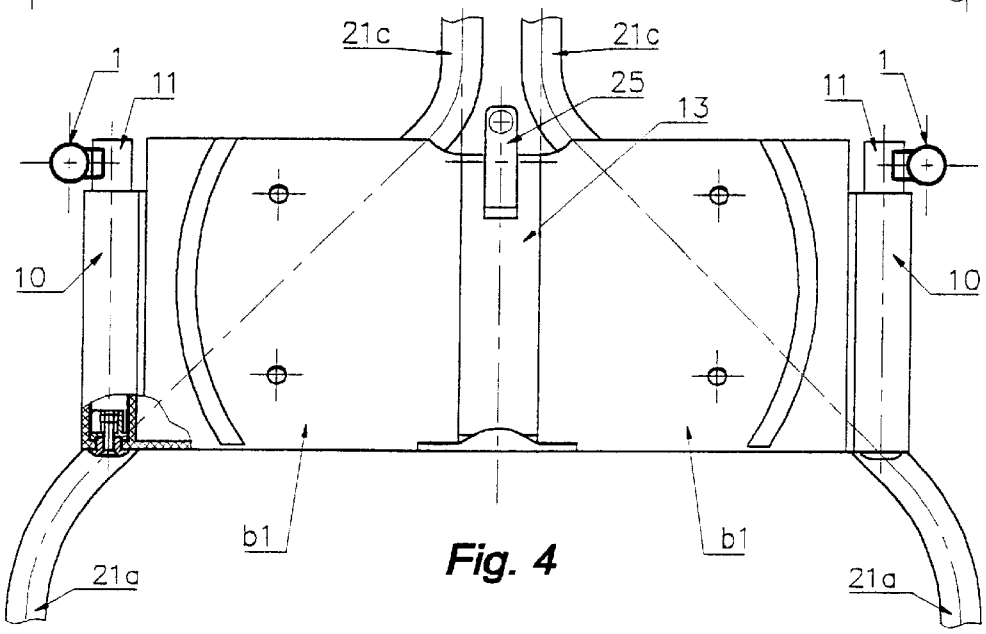
FIG. 4 is a plan view according to the arrow IV in FIG. 1.
Figure 5:
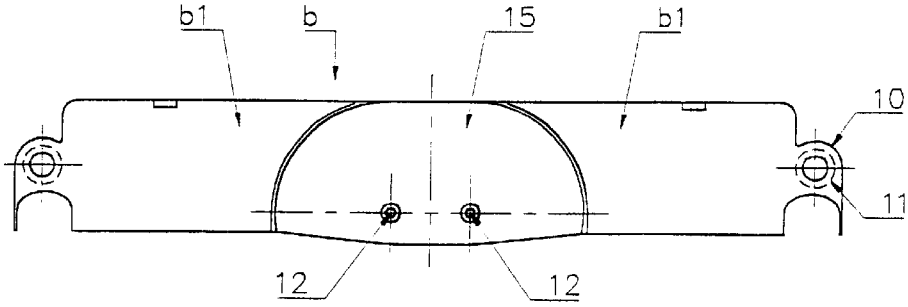
FIG. 5 is a rear view of the platform of the walking aid of FIGS. 1–4 in the folded position.

The upper transverse connection b is provided at about knee level and forms a special hinge joint bar. In the extended position it constitutes a platform which extends rearwardly from the frame section A. The upper hinge joint bar halves or platform halves $b_1$ are provided at their outer edge with a bushing 10 (see FIGS. 3 and 4 in particular), that is pivotally seated on a tubular stub 11, fastened to the inner side of the respective frame tube 1 and extending from the latter rearwardly. The two hinge joint bar halves or platform halves $b_1$ are connected to a central piece 13 about parallel axes 12 (see FIGS. 2, 3 and 5). On the front side of the central piece 13 (see FIGS. 2 and 3) there is provided a ring member 14 which projects forwardly from between the two platform halves and surrounds the upper free end of the tie rod 7 connected to it. A rear pivot plate 15 (see FIGS. 3 and 5) covers the central piece 13 at the rear side and is provided on the rearwardly extending ends of the pivot axes 12. In the use position (represented by solid lines in the drawings) the central piece 13 of the stretched platform b has its ring member 14 abutting the upper face of the guide piece 9 (see FIG. 2).

Figure 2:
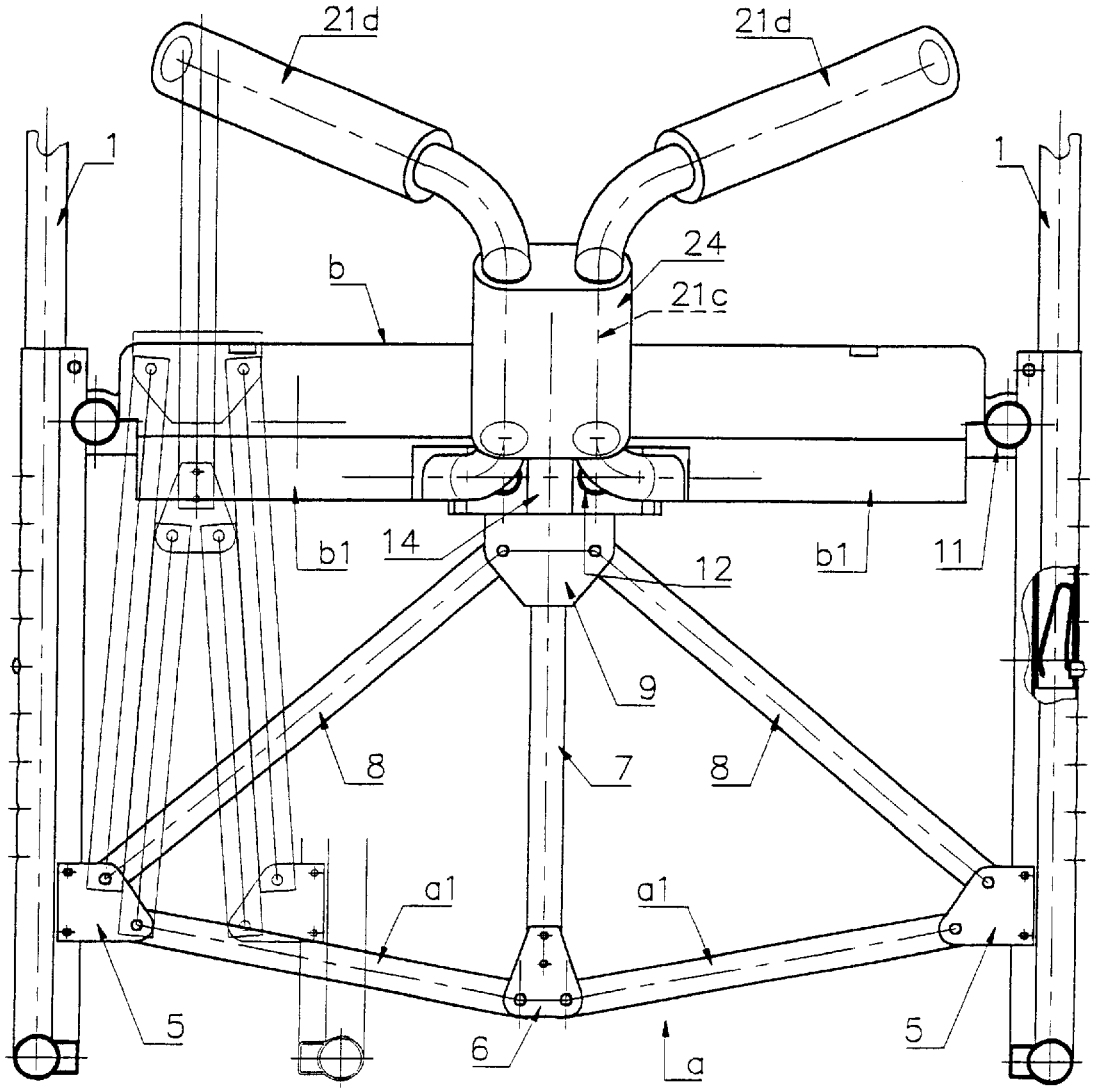
FIG. 2 is a front view as seen from the left in FIG. 1.

From the above it will be understood that applying an upwardly directed force to the central piece 13 of the platform b in FIG. 2 will cause the platform halves $b_1$ to swing upwardly about the tubular stubs 11. The ring member 14 of the central piece 13 will thereby be lifted from the guide piece 9, while taking the tie rod 7 along upwardly. The upward movement of the tie rod 7 causes the connecting piece 6 to be pulled from the lower (slightly "pushed through") position upwardly into and through the completely stretched position of the hinge joint bar a, whereby the hinge joint bar halves $a_1$ and the supporting links 8 will fold together while the tie rod 7 is sliding upwardly relative to the guide piece 9. This upward folding movements of the lower hinge joint bar 8 and the upper hinge joint platform b cause the two frame tubes 1 to be transversely pulled together.

The second frame section B essentially consists of two frame tubes 21, each comprising four substantially straight tube sections 21*a*–21*d*. In the use position shown in FIG. 1 the mutual parallel tube section 21*a* extend obliquely rearwardly from the stretched platform b at an angle to the vertical which is larger than the angle of inclination of the front frame section A and may be in the order of 40°. The frame tube sections 21*a* carry each at the lower end a rear wheel 22 and connect each adjacent a rear corner of the platform b through a connecting curve to a second frame tube section 21*b*, position in a plane parallel to the plane of the stretched platform b and extending from the respective corner of the stretched platform b obliquely forwardly towards the midplane of the platform b. The frame tube sections 21*b* are each rotatably and non slidably mounted to the lower side of a platform halve $b_1$ by means of fastening clips 23.

On the front side of the platform b (see particularly FIGS. 2 and 3) each of the frame tube sections 21*b* connect through a connecting curve to a third frame tube section 21*c*, the axes of which are substantially parallel to those of the frame tube sections 21*a*. The frame tube sections 21*c* extend through two slightly spaced parallel bores in a connecting piece 24. The upper end portions of the frame tube section 21*c* project upwardly beyond the connecting piece 24 to form tube sections 21*d* adapted to be used as handles.

The walking aid described hereinabove may, with a simple operation, be folded together from the use position in FIG. 1 in the rolling (walking) direction as well as in the transverse direction. As mentioned before when describing the front frame section A, applying an upwardly directed force to the central piece 13 of the platform b is enough for causing front frame section A to fold together in the transverse direction. Standing in front of, or even better, behind the walking aid—between the wheels 22—such force may be simply applied to the control handles 21*d* (see arrow P in FIG. 1). As a result of this the platform b will fold in the upward direction and this, in turn, will cause the tube sections 21*b* to turn about their axes, due to which the two frame tubes 21 as a whole will move relative to the frame tubes 1 of the front frame section A into the position represented by the dash-dotted lines. In reverse order the weight of the folded platform and the frame tubes will tend to cause the walking aid to unfold from a tending folded position into the use position shown in FIG. 1.

Figure 6:
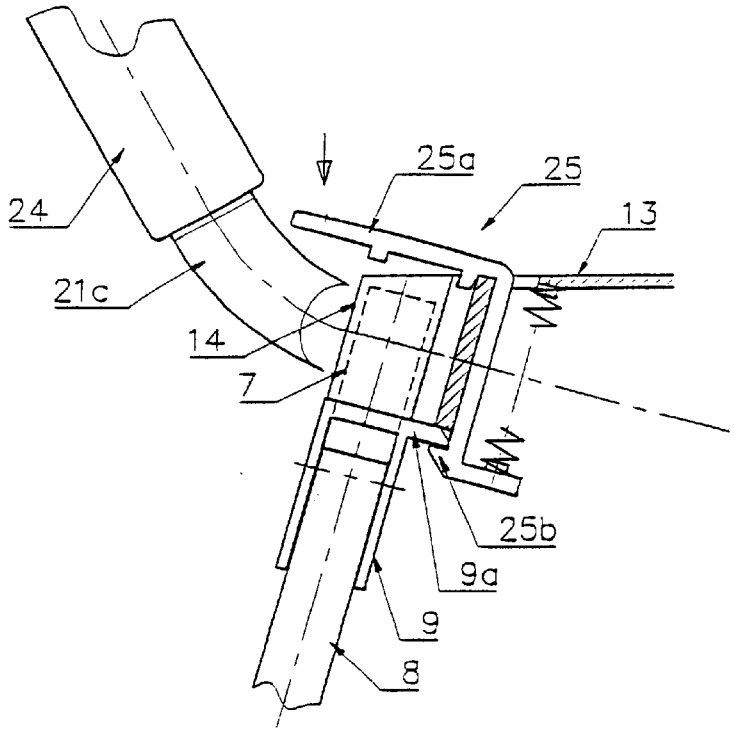
FIG. 6 is a plan view, partially in section according to the midplane of the walking aid, showing a detail of a locking mechanism.

The locking mechanism shown in FIG. 6 may be applied to have the walking aid locked in the use position. This locking mechanism comprises a substantially Z-shaped locking element 25, which is resiliently received in the center piece 13 of the platform b and extends with its upper flange portion 25*a* forwardly over the upper end 14 of the central piece 13. The locking element 25 is provided with a locking cam 25*b*, which, in the use position, engages a rearwardly extending locking edge 9*a* of the guide piece 9. In this way the central piece 13, 14 and the guide piece 9 are locked relative to one another, which excludes undesired folding of the walking aid.

To enable folding of the walking aid the locking element 25 may be simply depressed in the arrow direction indicated in FIG. 6, as a result of which the locking cam 25*b* gets disengaged from the locking edge 9*a*.

Thus the invention provides a rolling walking aid which may be folded to an easily handable package and the comfort and stability in the use position of which are as good as with a walking aid with a completely rigid frame.

When utilizing the stretched platform b, in the use position of the walking aid, as a seat both of the handles 21*d* may also function as a backrest.

From a viewpoint of rigidity it may be desired to provide a flexible connecting element 26 between the front frame section A and the frame tube sections 21*a* of the rear frame section B. Preferably the frame tubes 1 of the front frame sections A are telescopingly adjustable, as shown in the drawing.

Figure 7:
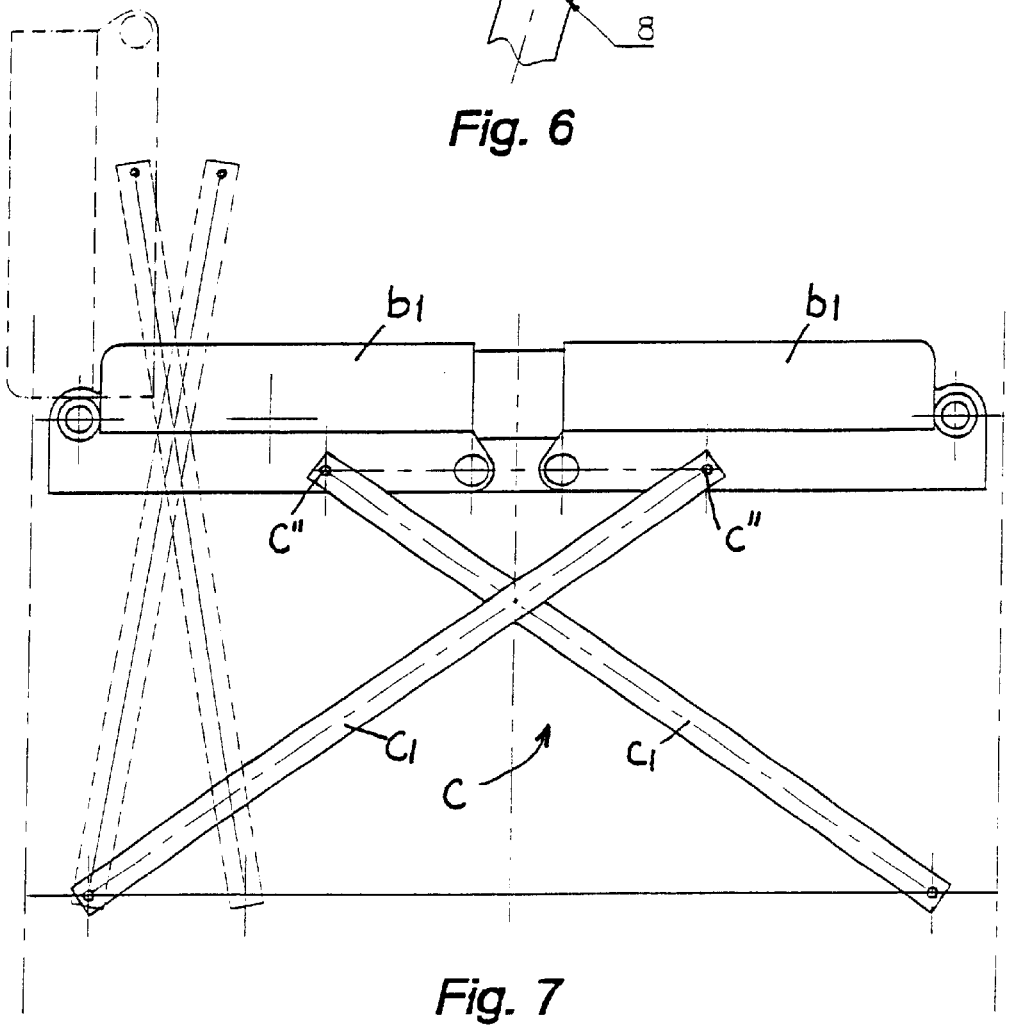
FIG. 7 shows an alternative for the lower hinge joint bar used in the embodiment according to FIGS. 1–6 and FIG. 8 is an elevational view of the aid according to the invention, now designed as a passive type of wheel chair.

As a simple alternative for the lower hinge joint bar a used in the embodiment according to FIGS. 1–6, FIG. 7 shows an assembly C of two crossing links c1, which may move relative to one another between the "semi-stretched" position shown by solid lines in FIG. 7 which corresponds with the use position of the walking aid, and the folded position represented by dashed lines in FIG. 7, the latter position corresponding with the folded position of the walking aid.

The coupling between the upper hinge joint platform b and the alternative lower bar assembly, required for folding the walking aid, is in this case effected by pivotally connecting each of the free ends of the links c1 to a platform halve b' at c".

The aid according to the present invention as shown in FIG. 1 is, in the first place, designed for use by elderly people and disabled people as a walking aid. As hereinabove, however, mention has already been made of the possibility to use the platform as a seat. In that case the aid is in fact a wheel chair of the passive type, which can be moved by a third person. The travelling direction will then be opposite to the travelling direction in FIG. 1, whereas the handles 21*d* may be serve as push bars.

Figure 8:
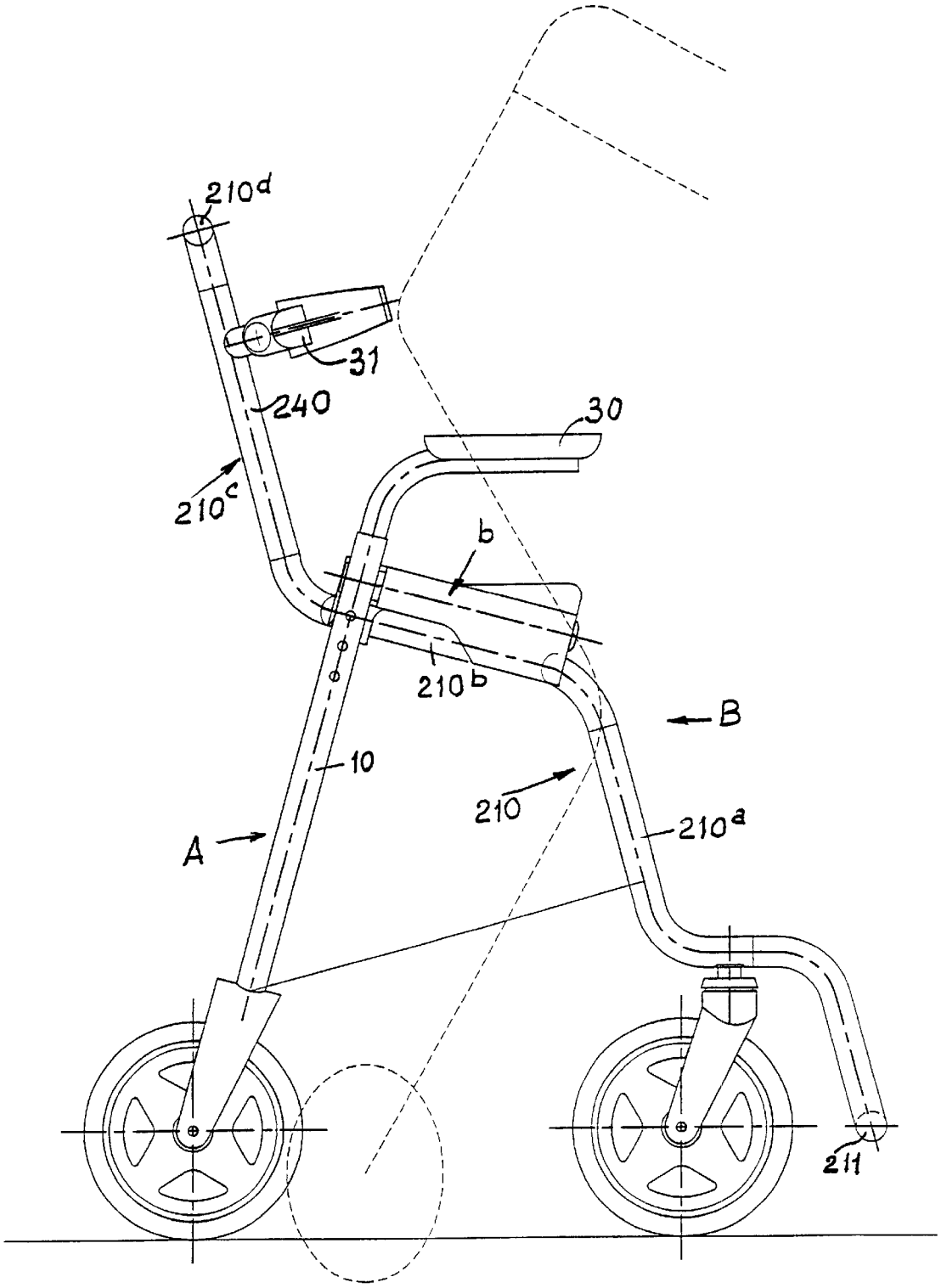

The embodiment shown in FIG. 8 is particularly adapted for use as a wheel chair. The major adaptations as compared with the walking aid of FIG. 1 are:

the push handle bars 3 of FIG. 1 have been transformed to an armrest 30 in FIG. 8;

the handle bars 21*d* of FIG. 1 are placed on a slightly higher level and transformed to transverse pushing bars 210*d* in FIG. 8;

in the embodiment of FIG. 8 a "real" backrest 31 is provided. Preferably the latter is formed from two parts, each of which is directly provided on a tube section 210*c* and extends from the latter in the transverse direction, so that folding the wheel chair together—which involves a rotary movement of the tube sections 210*c* about their axes—will cause the backrest to fold as well. The two backrest parts may be pivotally connected to one another in the area between the two tube sections 210*c* and about an axis that is parallel with said tube sections. The pivot connection may also form the connection between the two tube sections 210*c;* as compared with FIG. 1 the oblique tube section 210*a* and 210*c* of the rear frame section B (which in fact has become the front frame section in FIG. 8) are positioned at a slightly steeper angle;

as compared with the embodiment of FIG. 1 the fixed wheels and the swiveling wheels in the embodiment of FIG. 8 have been exchanged;

in the embodiment of FIG. 8 the lower end of the oblique tube section 210*a* has been bent inwardly to form a footrest 211.

The folding procedure and the folding mechanism has remained the same.

The embodiment of FIG. 8 is particularly suitable for domestic use, where a partner or helper will be generally available for a quick fold-out of the wheel chair to transverse the patient to another part of the house, after which the wheel chair may be refolded to a package that takes little space.

What is claimed is:

1. A rolling aid for use by elderly people and disabled people, comprising a frame provided with handle bars, said frame comprising a first and a second pair of frame bars or frame tubes which extend, in a rolling position, obliquely forwardly and rearwardly respectively with respect to a rolling (walking) direction and are provided at their lower ends with wheels, and a first upper and second lower foldable transverse connection between each two frame tubes forming a pair, which allow said pairs of frame tubes to be folded in a transverse direction with respect to said rolling (walking) direction, whereas said pairs are connected to one another in such a way, that they may be folded together about a transversely directed axis, wherein said first upper foldable transverse connection is formed as a foldable or hinge joint platform which takes, in the rolling position, a stretched position in a substantially horizontal plane, halves of said platform being pivotally connected in a vertical plane of symmetry of said aid and being each pivotally mounted to said frame tubes on a respective side of said aid for an upward folding movement, whereas said second lower foldable transverse connection is formed by a plurality of hinge bars provided on a lower level with respect to said platform of said upper foldable transverse connection, which connect said frame tubes of said first pair, which tubes extend upwardly beyond said stretched platform up to handle bar level, and a space between said obliquely downwardly extending frame tubes of said second pair, which, at the level of said stretched platform, deviate substantially horizontally towards said first pair of frame tubes, is free from transverse connections, wherein said platform halves are each hingedly connected to a frame tube of said first pair that extend, in an unfolded position, upwardly beyond said stretched platform and that tube sections of said frame tubes of said second pair which deviate, in the rolling position, substantially horizontally, are each directed from a location at a corner of said stretched platform on a respective side of said aid obliquely inwardly towards a connecting point at an opposite transverse edge of said platform, said respective side of said aid obliquely deviating tube sections being mounted to said respective platform halves for a rotary movement about their axes relative to said platform halves, while said tube sections of said frame tubes of said second pair which deviate, in the rolling position, substantially horizontally, are being prevented from turning about their axes relative to one another, said plurality of hinge bars of said second foldable transverse connection being, on one hand, exclusively connected to said frame tubes of said first pair and, on the other hand, directly connected to said platform.

2. An aid according to claim 1, wherein said plurality of hinge bars of said second foldable transverse connection comprises two links, which, in the unfolded position of said aid, are each extending from a frame tube of said first pair of frame tubes obliquely upwardly and inwardly to a pivot point at a respective longitudinal edge of said platform halve on an opposite side.

3. An aid according to claim 1, wherein the plurality of hinge bars of said second foldable transverse connection constitutes a hinge joint bar, a bending point of which is connected to a bending point of said platform through a tie rod.

4. An aid according to claim 3, comprising at least one support link, that extends, as seen in the rolling position of said aid, from a pivot location adjacent a lateral pivot of a hinge bar halve to a pivot connection with a guide piece that is positioned in a midplane of said first pair of frame tubes and under said platform in the stretched position of the latter, wherein said tie rod extends through said guide piece upwardly.

5. An aid according to claim 4, comprising a locking member, by means of which said guide piece and said bending point of said platform may be mutually locked in the rolling position of said aid.

6. An aid according to claim 1, wherein said deviating frame tube sections, which are pivotally connected to said platform, are each deviating, adjacent said connecting point at a respective transverse edge of said platform, upwardly to transfer into a frame tube section, an axis of which is at least substantially parallel to that of said respective frame tube section of said second pair of frame tubes that carries a wheel at its lower end, wherein the axes of said upwardly deviating frame tube sections are locked relative to one another in a transverse direction.

7. An aid according to claim 6, wherein the upper end portions of said upwardly deviating frame tube sections are bent to form handle bars.

8. An aid according to claim 1, wherein said platform halves have their outer ends rotatably mounted on axle stubs that extend from said frame tubes of said first pair of frame tubes towards said second pair of frame tubes.

9. An aid according to claim 8, wherein said axle stubs are formed by tubular stubs that extend from said respective frame tubes rearwardly.

10. An aid according to claim 9, wherein said platform halves are pivotally connected to a connecting piece about axes that are positioned parallel to said stubs, said connecting piece functioning as a bending point.

* * * * *